US009958833B2

(12) United States Patent
Sarchi et al.

(10) Patent No.: US 9,958,833 B2
(45) Date of Patent: May 1, 2018

(54) COUPLED TIMEPIECE OSCILLATORS

(71) Applicant: Montres Breguet S.A., L'Abbaye (CH)

(72) Inventors: Davide Sarchi, Zurich (CH); Sebastian Alagon Carrillo, Romainmotier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days. days.

(21) Appl. No.: 15/377,404

(22) Filed: Dec. 13, 2016

(65) Prior Publication Data

US 2017/0176939 A1 Jun. 22, 2017

(30) Foreign Application Priority Data

Dec. 18, 2015 (EP) ..... 15201032

(51) Int. Cl.
*G04B 17/06* (2006.01)
*G04B 17/26* (2006.01)

(52) U.S. Cl.
CPC ..... *G04B 17/063* (2013.01); *G04B 17/26* (2013.01)

(58) Field of Classification Search
CPC .... G04B 17/603; G04B 17/066; G04B 17/06; G04B 17/222; G04B 17/285; G04B 19/26; G04B 45/02; G04B 17/26
USPC ..... 368/168, 127, 175
See application file for complete search history.

(56) References Cited

U.S. PATENT DOCUMENTS 8,641,268 B2 * 2/2014 Villar ..... G04B 29/022 368/127
8,801,270 B2 * 8/2014 Helfer ..... G04F 7/0823 368/168
8,905,630 B2 * 12/2014 Helfer ..... G04F 7/08 368/101
2008/0192583 A1 8/2008 Buttet et al.
2011/0222377 A1 9/2011 Ching et al.

FOREIGN PATENT DOCUMENTS

CH 699 081 A2 1/2010
CH 709 281 A2 8/2015
EP 1 126 333 A1 8/2001
(Continued)

OTHER PUBLICATIONS

European Search Report dated Sep. 12, 2016 in European Application 15201032.8, filed on Dec. 18, 2015 (with English Translation of Categories of cited documents).

*Primary Examiner* — Edwin A. Leon
(74) *Attorney, Agent, or Firm* — Oblon, McClelland, Maier & Neustadt, L.L.P.

(57) ABSTRACT

Timepiece movement or watch including one isochronous oscillator mechanism, including only a first sprung balance oscillator including a first balance spring attached to a fixed structure at a first stud and to a first mobile component pivoting about a first axis, and a second sprung balance oscillator including a second balance spring fixed to a second mobile component, coupled to each other by mechanical connection via this second elastic return means attached to the first mobile component, this second balance spring being attached, to a felloe or an arm of the first mobile component at a second stud, and to this second mobile component which pivots about a second axis, and the maintenance of the oscillations is effected on only one of first mobile component or second mobile component.

18 Claims, 5 Drawing Sheets

(56) References Cited

FOREIGN PATENT DOCUMENTS

| | | | |
|---|---|---|---|
| EP | 2 365 403 | A2 | 9/2011 |
| WO | WO 2006/099882 | A1 | 9/2006 |
| WO | WO 2016/037717 | A2 | 3/2016 |

* cited by examiner

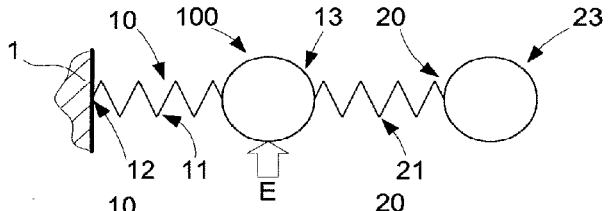
Fig. 1
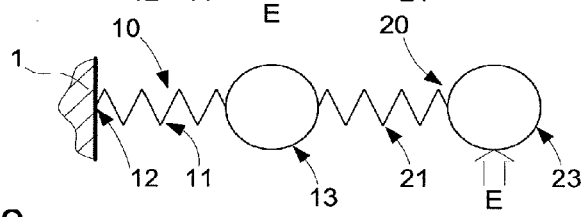
Fig. 2
Fig. 3
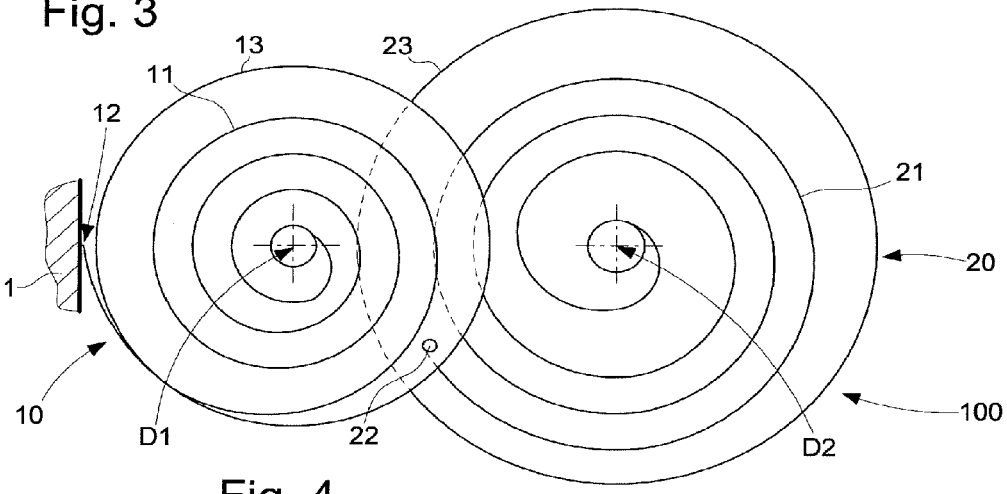
Fig. 4
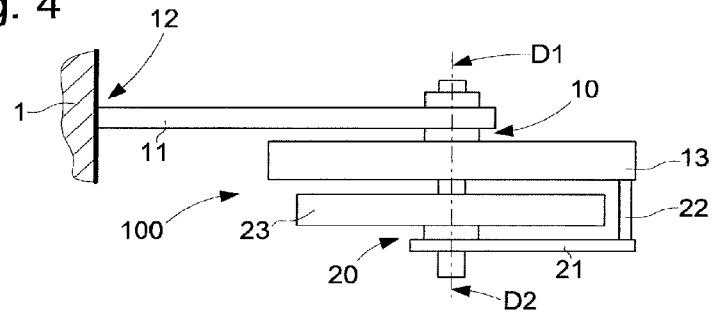
Fig. 5
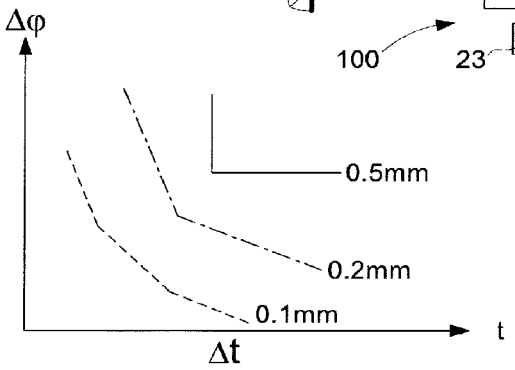

COUPLED TIMEPIECE OSCILLATORS

This application claims priority from European Patent application 15201032.8 of Dec. 18, 2015, the entire disclosure of which is hereby incorporated herein by reference.

FIELD OF THE INVENTION

The invention concerns an isochronous timepiece oscillator mechanism with coupled oscillators, consisting only of a first oscillator including a first elastic return means attached, on the one hand, to a fixed structure at a first anchoring point and, on the other hand, to a first mobile component pivoting about a first axis, and a second oscillator including a second elastic return means attached to a second mobile component.

The invention also concerns a timepiece movement including at least one such oscillator mechanism.

The invention also concerns a watch including such a movement.

The invention concerns the field of timepiece oscillator mechanisms, and the regulation of motion.

BACKGROUND OF THE INVENTION

The theory of coupling oscillators is always attractive, but the implementation thereof is thwarted by problems of instability.

EP Patent 2365403 in the name of SEAGULL discloses an oscillator for a mechanical timepiece comprising a first balance freely rotating about an axis; and a balance spring connecting this first balance to a fixed point or to a second balance, the balance spring comprising: a first coil connected to the first balance and a second coil connected to the fixed point or to the second balance, and a transition section connecting the first coil to the second coil, wherein a substantially linear restoring torque for at least one balance is essentially ensured by the elastic deformation of the transition section and the coils to produce an oscillating motion for at least one balance.

CH Patent 709281 in the name of THE SWATCH GROUP RESEARCH & DEVELOPMENT describes a forced oscillation resonator arranged to oscillate at a natural frequency and comprising, on the one hand, at least one oscillating member, and on the other hand, means for maintaining oscillation arranged to exert a torque on the oscillating member, which carries at least one oscillating regulator device whose natural frequency is a regulation frequency that is comprised between 0.9 times and 1.1 times an integer multiple of the natural frequency of said resonator mechanism, the integer being greater than or equal to 2. In particular, the regulator device includes, mounted to pivot freely on the oscillating member, at least one secondary sprung balance with an eccentric unbalance with respect to the secondary pivot axis about which the secondary sprung balance pivots.

EP Patent 112633 in the name of SEIKO describes a mechanical timepiece comprising a mainspring powering the mechanical time source, and a rotational angle control mechanism formed such that, in a state where the spring is completely wound, the air resistance is applied to rotation of the balance returned by a balance spring, and, in a state where the spring is completely unwound, the air resistance is not applied to rotation of the balance with the balance spring.

CH Patent 699081 in the name of THE SWATCH GROUP RESEARCH & DEVELOPMENT describes a resonator resulting from the coupling of a first low frequency resonator with a second higher frequency resonator, wherein the first resonator includes a first inertial mass associated with a first spring, the second resonator includes a second inertial mass associated with a second spring, and wherein a third spring is disposed between the first and second inertial masses for coupling the first and second resonators.

WO Patent 2016/037717 in the name of ETA MANUFACTURE HORLOGERE SUISSE discloses a regulator comprising, mounted to move in at least a pivoting motion with respect to a plate, an escape wheel arranged to receive a drive torque via a gear train, a first oscillator comprising a first rigid structure connected to the plate by first elastic return means. This regulator also comprises a second oscillator with a second rigid structure connected to the first rigid structure by second elastic return means, which are arranged to allow at least a pivoting motion of the second rigid structure with respect to the first rigid structure. The second structure comprises guide means arranged to cooperate with complementary guide means comprised in the escape wheel, together forming a motion transmission means for synchronizing the first oscillator and the second oscillator with the gear train.

SUMMARY OF THE INVENTION

The invention proposes to define simplified coupled oscillators, which make it possible to obtain good mode stability and which are easy to produce.

The invention thus concerns an isochronous timepiece oscillator mechanism with coupled oscillators according to claim 1.

The invention also concerns a timepiece movement including at least one such oscillator mechanism.

The invention also concerns a watch including a movement of this type.

BRIEF DESCRIPTION OF THE DRAWINGS

Other features and advantages of the invention will appear upon reading the following detailed description, with reference to the annexed drawings, in which:

FIG. 1 represents a schematic view of an oscillator mechanism with two coupled oscillators, the first of which includes a first elastic return means attached between a structure and a first mobile component, on which is attached a second elastic return means attached at the other end thereof to a cantilevered second mobile component, with excitation effected only on the first mobile component.

FIG. 2 represents, in a similar manner to FIG. 1, the same oscillator mechanism, but in which excitation is effected on the second mobile component.

FIG. 3 represents a schematic plan view of an oscillator mechanism with two coupled oscillators of the sprung balance type, the first of which includes a first balance spring attached between a structure and a first balance, which carries a balance spring stud for attachment of a second balance spring of the second oscillator, attached at the other end thereof to a second balance.

FIG. 4 represents a schematic side view of an oscillator mechanism with two coupled oscillators of the sprung balance type, wherein the two balances are coaxially mounted.

FIG. 5 is a simplified diagram showing how a certain phase shift is obtained, at the end of a certain time lapse, and the shape of the phase shift variation curve, as a function of the space between aerodynamically coupled mobile components.

DETAILED DESCRIPTION OF PREFERRED EMBODIMENTS

Figure 6:
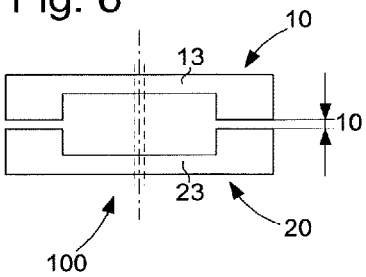
FIGS. 6 and 7 illustrate schematic views of the aerodynamic coupling between the rims of two coaxial balances of substantially the same diameter facing each other front frontally in FIG. 6, and incorporated one within the other in FIG. 7.
Figure 7:
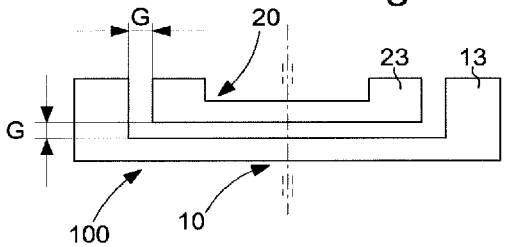

The invention concerns an isochronous timepiece oscillator mechanism 100 with coupled oscillators, which is achieved very simply, by the combination of only two primary oscillators: this oscillator mechanism 100 consists only of a first oscillator 10 and a second oscillator 20.

We name in the present description a "mobile component" any component able to pivot around a pivot axis, namely a wheel set in a non-limiting embodiment.

First oscillator 10 includes a first elastic return means 11, which is attached, on the one hand, to a fixed structure 1 at a first anchoring point 12, and on the other hand, to a first mobile component 13 pivoting about a first axis D1.

Second oscillator 20 includes a second elastic return means 21 attached to a second mobile component 23.

According to the invention, first oscillator 10 and second oscillator 20 are coupled to each other, by aerodynamic connection between first mobile component 13 and second mobile component 23 and/or by mechanical connection via second elastic return means 21, which is then attached to first mobile component 13.

In particular, there is only one first elastic return means 11 and only one second elastic return means 21.

More particularly, first oscillator 10 and second oscillator 20 are coupled to each other, both by aerodynamic connection between first mobile component 13 and second mobile component 23, and by mechanical connection via second elastic return means 21 which is attached to first mobile component 13.

In a particular embodiment of the invention, second elastic return means 21 is a monolithic articulated structure or flexible bearing with thin strips.

In a particular and non-limiting embodiment of the invention, first oscillator 10 is of the sprung balance type, and first elastic return means 11 is a first balance spring attached to fixed structure 1 by a first balance spring stud forming first anchoring point 12. Second oscillator 20 is also of the sprung balance type, and a second elastic return means 21 is a second balance spring attached to a second mobile component 23.

In other embodiments of the invention, first elastic return means 11, and/or second elastic return means 21 for coupling, is a thin resilient strip, or similar.

In a particular variant of this embodiment comprising balance springs, second spring 21 is attached, on the one hand to the rim or to an arm of first mobile component 13 at a second balance spring stud 22, and on the other hand, to second mobile component 23, which pivots about a second axis D2. Maintenance of the oscillations of oscillator mechanism 100 is effected on only one of the first mobile component 13 or the second mobile component 23.

In another variant, maintenance of the oscillations is effected independently on each of the two primary oscillators 10 and 20.

More particularly, the rigidity of the second elastic return means 21 is less than half the rigidity of first elastic return means 11.

More particularly still, the rigidity of second elastic return means 21 is comprised between 0.30 and 0.40 times the rigidity of first elastic return means 11.

More particularly, the inertia of second mobile component 23 is less than one third of the inertia of first mobile component 13.

More particularly still, the inertia of second mobile component 23 is comprised between 0.20 and 0.30 times the inertia of first mobile component 13.

In a particular embodiment, first mobile component 13 and second mobile component 23 are balance wheels.

In another particular embodiment, first mobile component 13 or second mobile component 23 is a carriage of a tourbillon or a karussel, and second mobile component 23 or respectively first mobile component 13 is a balance wheel.

More particularly, the balance wheel forming second mobile component 23, or respectively first mobile component 13, is coaxial to the tourbillon or karussel carriage forming first mobile component 13, or respectively second mobile component 23, and is pivoted inside the carriage. The second balance spring stud 22 of second oscillator 20 is attached to an arm or to a drum of the carriage. Maintenance of the oscillations of oscillator mechanism 100 is effected by a pallet lever 3 or a detente cooperating with a small roller attached to the tourbillon or karussel at the pivot axis thereof.

In a particular embodiment, which is advantageous for permitting aerodynamic coupling, the minimum distance G between parts of large diameter, particularly the parts of largest diameter, of first mobile component 13 and of second mobile component 23 is less than 0.5 mm. This aerodynamic coupling is advantageous, even when a main coupling is achieved by second elastic return means 21, since the aerodynamic coupling tends to stabilise oscillator mechanism 100 over only one of the two modes (inphase or in phase opposition). An aerodynamic coupling exists even with discontinuous services, for example between the arms 4 of a tourbillon or karussel carriage on the one hand, and a balance rim 5 on the other.

Advantageously, oscillator mechanism 100 includes means for varying this distance between first mobile component 13 and second mobile component 23, preferably within the range 0.1 to 0.5 mm.

FIG. 5 is a diagram roughly illustrating the shape that the phase shift curve can take as a function of time, demonstrating that, at a certain value, notably close to 0.5 mm, the phase shift stabilises at a substantially constant value. Of course, a certain transitional regime duration $\Delta T$ is required before reaching stabilisation, for example around 200 seconds for an oscillator consisting of two conventional timepiece sprung balances, oscillating at 3 Hz, where the balances are coplanar and separated by 0.5 mm.

In a particular embodiment, second mobile component 23 and first mobile component 13 are coaxial.

In another particular embodiment, at least in projection, second mobile component 23 is inside first mobile component 13.

In another particular embodiment, the parts of greatest diameter of first mobile component 13 and of second mobile component 23, which are positioned on two different stages, are of substantially the same diameter and substantially opposite each other.

In this latter variant, and with no particular embodiment, the second elastic return means 21 is a second balance spring which extends over two stages.

In yet another particular embodiment, second mobile component 23 and first mobile component 13 are positioned side-by-side and are substantially coplanar.

Figure 8:
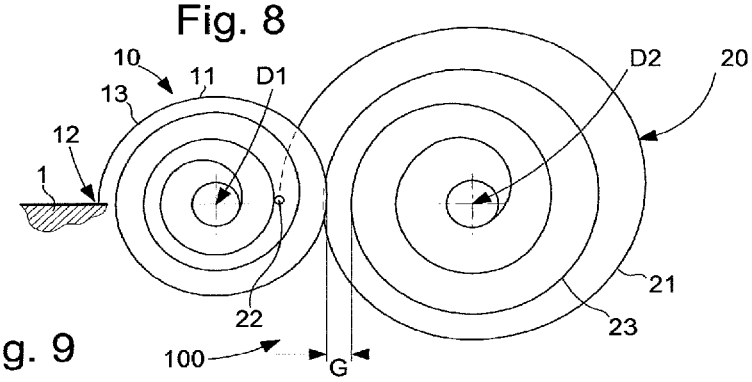
FIG. 8 shows an aerodynamic coupling between two very close balances, in an arrangement according to FIG. 3.
Figure 9:
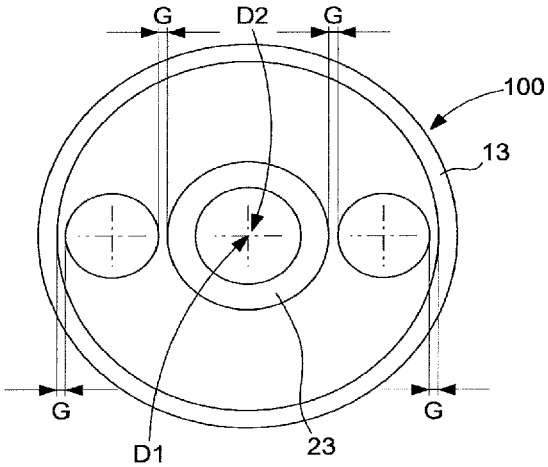
FIG. 9 shows an aerodynamic coupling with washers or balls disposed between two balances arranged according to FIG. 7.
Figure 15:
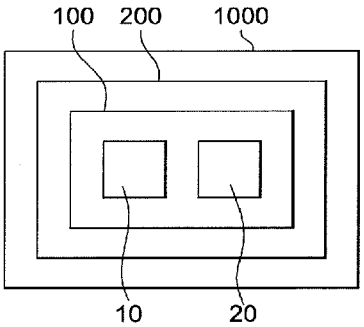
FIG. 15 is a block diagram representing a watch including a timepiece movement comprising such an oscillator mechanism with two coupled oscillators.
Figure 10:
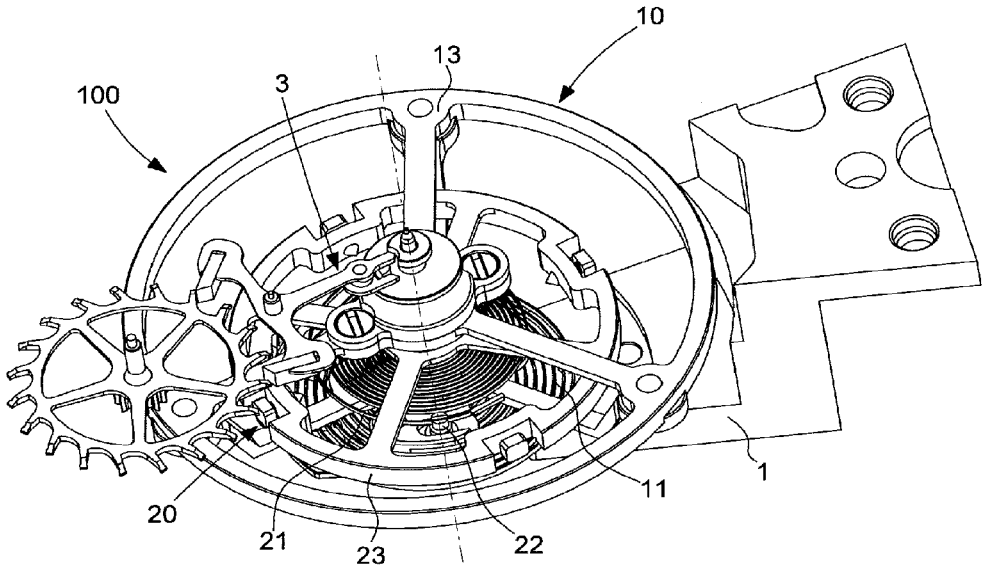
FIGS. 10 to 14 are different perspective views of the same mechanism comprising a fixed structure carrying the outer coil of a first balance spring whose inner coil is attached to the carriage of a tourbillon, which carries a first end of a second balance spring still attached at its other end to a balance coaxial to the carriage.
Figure 11:
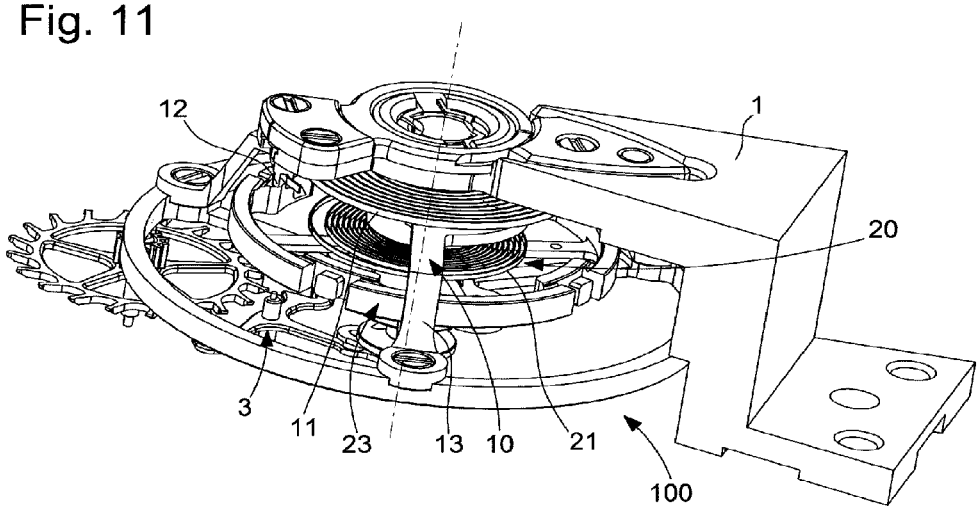
Figure 12:
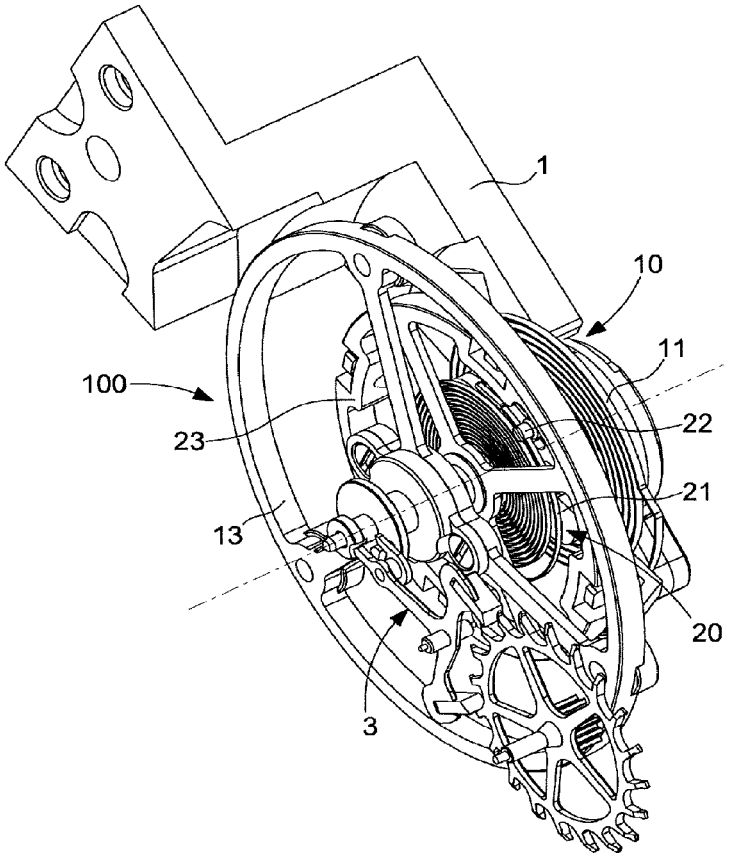
Figure 13:
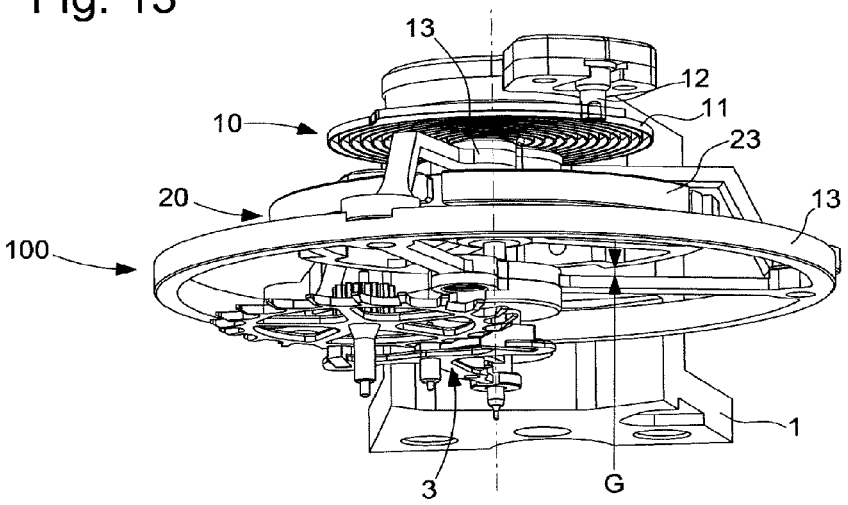
Figure 14:
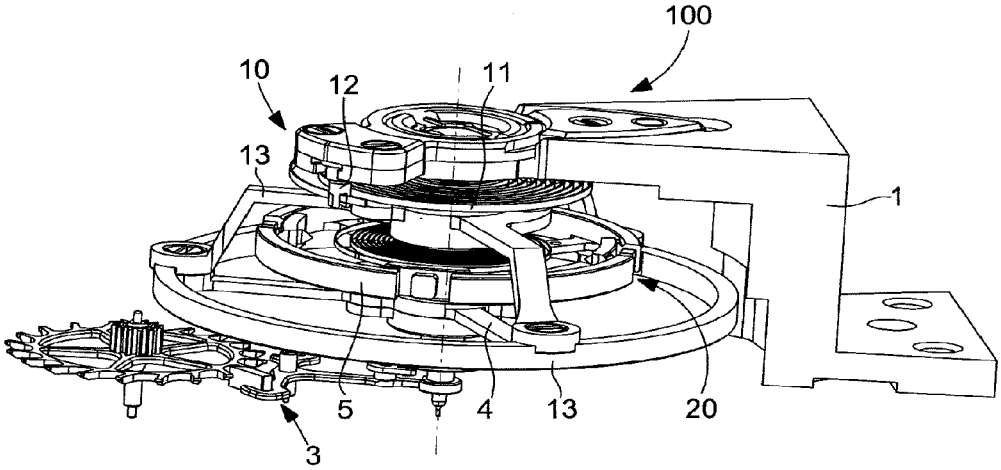

FIG. 9 shows an aerodynamic coupling with washers or balls or similar, disposed between two balances. This solution is also applicable to a variant of the FIG. 8 solution, with a third mobile component positioned between the two balances. More particularly, at least a third mobile component is inserted between the parts of largest diameter of first mobile component 13 and of second mobile component 23, this third mobile component having only the freedom to pivot on itself or to slide in a direction orthogonal to the straight line that defines the minimum distance between the parts of largest diameter of first mobile component 13 and of said second mobile component 23. More particularly still, the third mobile component is attached to a third elastic return means independent of the first elastic return means and of the second elastic return means to define a third oscillator, coupled by aerodyanic connection to first oscillator 10 and to second oscillator 20.

The insertion of one or more mobile components ensures the stabilisation of the system of two coupled oscillators in the anti-phase mode, which has a higher frequency. Each of these mobile components can be connected to an independent elastic return means, thereby imposing a regular oscillation of the mobile component. In the case of balance wheels, such a variant can be achieved in a MEMS type or similar embodiment, made of micromachinable material, of the silicon or other type, with integrated flexible bearings.

The invention also concerns a timepiece movement 200 including at least one such oscillator mechanism 100.

The invention also concerns a watch 1000 including a movement 200 of this type.

What is claimed is:

1. An isochronous timepiece oscillator mechanism with coupled oscillators, consisting only of a first oscillator including a first elastic return attached to a fixed structure at a first anchoring point and to a first mobile component pivoting about a first axis, and a second oscillator including a second elastic return fixed to a second mobile component, wherein said first oscillator and said second oscillator are coupled to each other by mechanical connection via said second elastic return which is then attached to said first mobile component, wherein said first oscillator is a first sprung balance oscillator and wherein said first elastic return is a first balance spring attached to said fixed structure by a first balance spring stud forming said first anchoring point, and wherein said second oscillator is a second sprung balance oscillator and wherein said second elastic return is a second balance spring attached to said second mobile component, wherein said second balance spring is attached to the felloe or to an arm of said first mobile component at a second balance spring stud and to said second mobile component which pivots about a second axis, wherein maintenance of the oscillations of said oscillator mechanism is effected on only one of said first mobile component or second mobile component.

2. The oscillator mechanism according to claim 1, wherein at least a third mobile component is inserted between the parts of largest diameter of said first mobile component and of said second mobile component, said third mobile component having only the freedom to pivot on itself or to slide in a direction orthogonal to the straight line that defines the minimum distance between the parts of largest diameter of said first mobile component and of said second mobile component.

3. The oscillator mechanism according to claim 2, wherein said third mobile component is attached to a third elastic return independent of said first elastic return and of said second elastic return to define a third oscillator coupled by aerodynamic connection to said first oscillator and to said second oscillator.

4. The oscillator mechanism according to claim 1, wherein the rigidity of said second elastic return is less than half the rigidity of said first elastic return.

5. The oscillator mechanism according to claim 4, wherein the rigidity of said second elastic return is comprised between 0.30 and 0.40 times the rigidity of said first elastic return.

6. The oscillator mechanism according to claim 1, wherein the inertia of said second mobile component is less than one third the inertia of said first mobile component.

7. The oscillator mechanism according to claim 6, wherein the inertia of said second mobile component is comprised between 0.20 and 0.30 times the inertia of said first mobile component.

8. The oscillator mechanism according to claim 1, wherein said first mobile component and said second mobile component are balance wheels.

9. The oscillator mechanism according to claim 1, wherein said first mobile component or said second mobile component is a carriage of a tourbillon or of a carousel, and wherein said second mobile component or respectively said first mobile component is a balance wheel.

10. The oscillator mechanism according to claim 9, wherein said balance wheel forming said second mobile component or respectively said first mobile component is coaxial to the carriage of said tourbillon or carousel forming said first mobile component or respectively said second mobile component, and pivoted inside said carriage, wherein said second balance spring stud of said second oscillator is attached to an arm or to the drum of said carriage, and wherein maintenance of the oscillations of said oscillator mechanism is effected by a pallet lever or a detent cooperating with a small roller attached to said tourbillon or carousel at the pivot axis thereof.

11. The oscillator mechanism according to claim 1, wherein the minimum distance between the parts of largest diameter of said first mobile component and of said second mobile component is less than 0.5 mm.

12. The oscillator mechanism according to claim 1, wherein said second mobile component and said first mobile component are coaxial.

13. The oscillator mechanism according to claim 1, wherein, at least in projection, said second mobile component is inside said first mobile component.

14. The oscillator mechanism according to claim 1, wherein the parts of largest diameter of said first mobile component and of said second mobile component, which are positioned on two different stages, are of substantially the same diameter and substantially opposite each other.

15. The oscillator mechanism according to claim 14, wherein said second elastic return is a second balance spring that extends over two stages.

16. The oscillator mechanism according to claim 1, wherein said second mobile component and said first mobile component are positioned side by side and substantially coplanar to each other.

17. A timepiece movement including at least one oscillator mechanism according to claim 1.

18. A watch including a movement according to claim 17.

* * * * *